US005537964A

United States Patent [19]

Hoshiba

[11] Patent Number: 5,537,964

[45] Date of Patent: Jul. 23, 1996

[54] ENGINE CHOKE ACTUATION SYSTEM

[75] Inventor: Akihiko Hoshiba, Hamamatsu, Japan

[73] Assignee: Sanshin Kogyo Kabushiko Kaisha, Shizuoka-ken, Japan

[21] Appl. No.: 302,170

[22] Filed: Sep. 8, 1994

[30] Foreign Application Priority Data

Sep. 8, 1993 [JP] Japan ..... 5-223743

[51] Int. Cl.[6] ..... F02M 1/12

[52] U.S. Cl. ..... 123/179.18

[58] Field of Search ..... 123/179.18, 438, 123/179.16, 580, 59.5, 339.24, 339.22; 261/39.2, 39.3, 39.6

[56] References Cited

U.S. PATENT DOCUMENTS

| | | | |
|---|---|---|---|
| 2,127,653 | 8/1938 | Sisson | 123/179.16 |
| 2,446,352 | 8/1948 | Winter | 123/179.16 |
| 4,050,424 | 9/1977 | Nelson | 261/39.3 |
| 4,662,333 | 5/1987 | Martel | 123/179.18 |
| 5,326,293 | 7/1994 | Shishido et al. | 123/580 |

FOREIGN PATENT DOCUMENTS 3-21551 3/1991 Japan .

*Primary Examiner*—Andrew M. Dolinar
*Attorney, Agent, or Firm*—Knobbe, Martens, Olson & Bear

[57] ABSTRACT

An engine choke actuation system controls both the opening degree of the choke and throttle valves of a plurality of charge formers during all phases of engine warmup. The engine choke actuation system includes a first device which acts to close the choke valve at the time of engine starting. A second device restricts a degree of closure of the choke valve by the first device depending upon the temperature of the engine at the time of engine starting. The second device also controls the opening degree of the choke valves after engine starting, increasing the opening degree of the choke valve with increasing engine temperature. In addition, the second device controls the fast idle angle of the throttle valves during engine warmup, decreasing the fast idle angle of the throttle valves as the engine temperature increases.

34 Claims, 4 Drawing Sheets

ENGINE CHOKE ACTUATION SYSTEM

BACKGROUND OF THE INVENTION

1. Field of the Invention

The present invention relates in general to an internal combustion engine, and more particularly to an engine cold starting control device.

2. Description of Related Art

To start an engine efficiently and effectively, the fuel/air ratio of a fuel charge delivered to the engine should be controlled both at the time of starting the engine (i.e, cranking the engine) and during the time the engine warms to its designed operating temperature.

When starting a cold engine, the fuel charge should contain a higher concentration of fuel (i.e., be "richer") because some percentage of the fuel will condense on the cool induction system of the engine before the charge is delivered to the combustion chamber. The initial ratio of fuel to air thus must be richer in order to supply a change having the proper fuel to air ratio. Of course, colder weather exacerbates this problem; with a lower starting temperature, a large percentage of the fuel in the charge condensates on the colder surfaces of the induction system.

Conventional charge formers use various types of cold starting devices to produce a richer charge when starting a cold engine. For instance, a choke valve is used in a conventional carburetor to decrease air flow into a mixture chamber of the carburetor, and consequently the concentration of fuel in the charge is increased.

In order to compensate for variable starting temperatures of the engine, it is known to adjust the choke valve to tailor the opening degree of the choke valve to the starting temperature of the engine. Colder starting temperatures require a smaller opening degree (i.e., less air flow) in order to produce a rich charge, and warmer starting temperatures require a larger opening degree (i.e., more air flow) to produce a less rich charge.

The engine warms after starting. Less fuel condensation occurs as the engine and its induction system warms, and consequently, the percentage of fuel in the fuel charge can be decreased. The fuel to air ratio desirably decreases at a rate corresponding to the rise in engine temperature to maintain consistency in engine performance. Thus, the fuel to air ratio of the charge gradually decreases to a designed ratio for operation after the engine has warmed.

Conventional cold start devices, which employ only a choke valve or a similar device, do not gradually decrease the fuel concentration level of the charge. These prior devices rather run richer than required under some operating temperatures and leaner than required under other operating temperature. As a result, engine efficient is sacrificed under some operating conditions and engine performance is sacrificed under other operating conditions.

SUMMARY OF THE INVENTION

A need therefore exists for a simply structured engine starter control device which automatically controls the fuel concentration level (i.e., the opening degrees of the choke and throttle valves of a charge former) depending upon engine temperature, from engine start through engine warmup.

In accordance with an aspect of the present invention, an engine choke actuation system is used with at least one charge former. The charger former includes a choke valve operated by a choke shaft. The choke shaft moves the choke valve through a range of opening degrees between a close position and a full open position. The engine choke actuation system includes a first device which acts to close the choke valve at the time of engine starting. A second device restricts the degree of closure of the choke valve by the first device depending upon the temperature at the time of engine starting. The second device also controls the opening degree of the choke valve after engine starting.

BRIEF DESCRIPTION OF THE DRAWINGS

These and other features of the invention will now be described with reference to the drawings of a preferred embodiment which is intended to illustrate and not to limit the invention, and in which.

DETAILED DESCRIPTION OF THE PREFERRED EMBODIMENT

Figure 1:
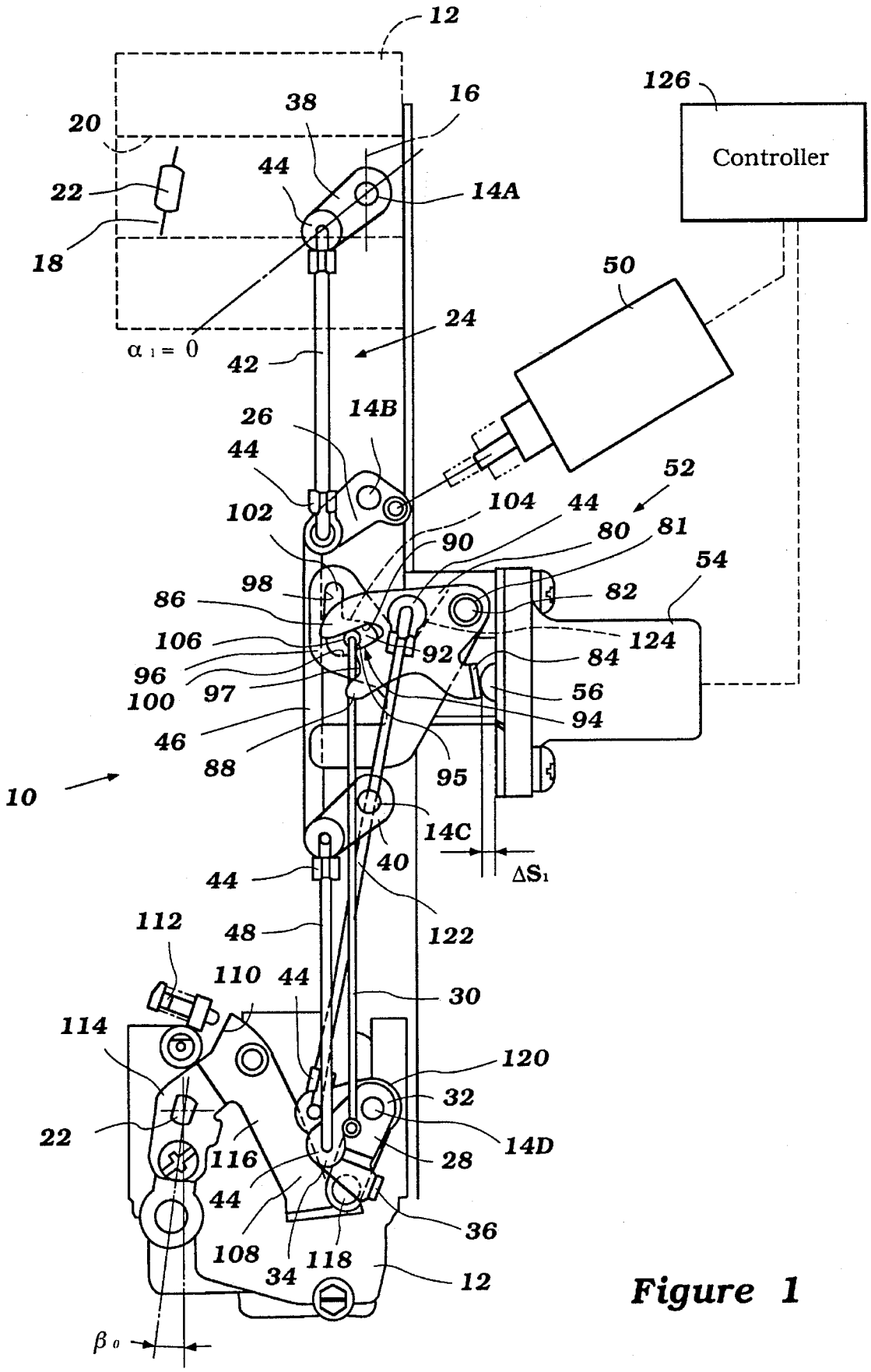
FIG. 1 is a side elevational view of a choke actuation system in accordance a preferred embodiment of the present invention illustrated under cranking conditions at −5° C.

FIG. 1 illustrates an engine choke actuation system 10 configured in accordance with a preferred embodiment of the present invention. Though it is understood that the present invention can be incorporated into any type of internal combustion engine, the present invention is particularly well suited for application in conjunction with a vertically oriented engine of a marine outboard motor. The choke actuation system 10 thus will be disclosed as vertically oriented as illustrated in FIG. 1. It is contemplated, however, that certain aspects of the invention can be employed with an inbound/outbound motor equally as well.

The present choke actuation system 10 is designed for use in conjunction with at least one and preferably a plurality of carburetors 12. Although the illustrated choke actuation system 10 is configured to control four in-line carburetors 12, it is contemplated that those skilled in the art can readily adapt the present invention to applications involving other numbers of carburetors and/or other orientations. It should also be understood that certain aspects of the present invention also lend themselves to applications involving other types of cold starting devices used with other types of charge formers, such as, for example, fuel injectors.

FIG. 1 illustrates four spaced choke valve shafts 14 of four in-line carburetors 12 which are spaced apart from one another; however, only the body of two of the carburetors 12 are illustrated (one in phantom) in order to simplify the drawing. For ease of description, each choke shaft 14 will be designed by an A, B, C, or D suffix, identified from the top down, and a collection of choke shafts shall be designated generally by reference numeral 14, without suffix.

The carburetors 12 may be of any known type and construction; however, each carburetor 12 is provided with a choke valve 16 and a throttle valve 18 (schematically illustrated in FIG. 1) to regulate the mixture of fuel and air to each cylinder of the engine, as known in the art. The choke shaft 14 supports the choke valve 16 within an internal passage 20 of the carburetor body 12 and controls the opening degree of the choke valve 16, as discussed below and as known in the art. In the illustrated embodiment, the choke valve 16 desirably is an offset butterfly-type valve, and rotation of the choke shaft 14 moves the choke valve 16 between a closed position and a full open position. The choke shaft 14 thus controls the angle of the choke valve relative to its closed position (i.e., the choke angle $\alpha$). FIG. 1 schematically illustrates the choke valve 14 in the close position (i.e., $\alpha=0°$). Although the present choke actuation system 10 is described in connection with a butterfly-type valve, it should be understood that the present invention can be used equally well with other types of choke valves, such as, for example, slider type valves.

FIG. 1 also illustrates a throttle shaft 22 of the carburetor 12 which supports the throttle valve 18 within the internal passage 20 of the carburetor 12. Like the choke valve 16, the throttle valve 18 desirably is an off-set butterfly-type valve, but it is understood that other types of valves, such as slider valves, can be used with the present choke actuation system 10 equally as well. Rotation of the throttle shaft 22 controls the orientation of the throttle valve 18 within the internal passage 20, as known in the art. Although not illustrated in FIG. 1 for simplicity, it is understood that each carburetor 12 includes a throttle valve 18 operated by a throttle shaft 22 and the shafts are interconnected by a throttle linkage mechanism. A suitable throttle linkage mechanism is disclosed in U.S. patent application Ser. No. 05/302,627, filed Sep. 8, 1994, in the names of Sadato Yoshida, Hiroshi Nakai, and Akihiko Hoshiba, and Yasuhiko Shibata and assigned to the assignee hereof, which is hereby incorporated by reference.

As illustrated in FIG. 1, a choke linkage 24 interconnects the choke shafts 14. The choke linkage 24 includes a series of choke levers interconnected by a plurality of linkage rods. Specifically, the choke linkage 24 includes an L-shaped choke lever 26 attached to one of the choke shafts. In the illustrated embodiment, the L-shaped choke lever 26 is attached to the second choke shaft 14B.

The choke linkage 24 also includes a carrier choke lever 28 which, in addition to connecting to a linkage rod, also carries an end of a choke angle control rod 30, as discussed in detail below. In the illustrated embodiment, the carrier choke lever 28 is attached to the fourth choke shaft 14D of the fourth carburetor 12, although it is understood that other locations are possible. The carrier choke lever 28 generally has a triangular shape and includes a first aperture 32 at a first corner. The first aperture 32 receives the choke shaft 14D to secure together the carrier choke lever 28 and the choke shaft 14D. A second corner includes a second aperture 34 used to interconnect the carrier choke lever 28 to a linkage rod, as discussed below, and a third corner of the carrier choke lever 28 includes a tang 36.

Conventionally shaped choke levers 38, 40 are attached to the balance of the choke shafts. In the illustrated embodiment, these choke levers 38, 40 attach to the first and third choke valve shafts 14A, 14C, respectively.

Linkage rods interconnect the ends of the choke levers at a point distal of the choke shafts 14. In the illustrated embodiment, a first linkage rod 42 extends between the distal ends of the first and second choke levers 38, 26. Conventional clips 44, which engage an aperture in the distal end of each choke lever 26, 38, connect the ends of the first linkage rod 42 to the first and second choke levers 38, 26. The first linkage rod 42 desirably has a standard cylindrical shape.

A second linkage rod 46 extends between the distal ends of the second and third choke levers 26, 40. The second linkage rod 46 desirably has a flattened cross-sectional shape and includes an aperture at each of its ends to receive one transversely bent end of the first linkage rod 42 and one transversely bent end of a third linkage rod 48. Clips 44 connect an upper end of the second linkage rod 46 to the distal end of the second choke lever 26 and to the lower end of the first linkage rod 42, and connect a lower end of the second linkage rod 46 to the distal end of the second choke lever 26 and to an upper end of the third linkage rod 48, in a known manner.

The third linkage rod 48 extends between the distal ends of the third choke lever 40 and the carrier choke lever 28. A lower end of the third linkage rod 48 inserts through the second aperture 34 of the carrier choke lever 28. A conventional clip 44 connects the lower end of the third linkage rod 48 to the distal end of the carrier choke lever 28. The third linkage rod 48 has a conventional cylindrical shape.

As seen in FIG. 1, a choke solenoid 50 is coupled to the choke linkage 24 to operate the choke shafts 14 in unison. In the illustrated embodiment, the solenoid 50 is attached to the L-shaped choke lever 26 attached to the second choke shaft 14B; however, it is understood that the choke solenoid 50 and the corresponding L-shaped choke lever 26 can be positioned on any choke shaft 14 provided that the position also accounts for the spacing demand of the engine layout. The solenoid 50 desirably is mounted to the engine proximate to the carburetors 12, and more preferably is attached to a support bracket (not shown) which also interconnects the carburetors 12. A suitable mounting arrangement and assembly is disclosed in U.S. patent application Ser. 08/302,217, filed Sep. 8, 1994, in the names of Hiroshi Nakai, Akihiko Hoshiba and Yasuhiko Shibata, and assigned to the assignee hereof, which is hereby incorporated by reference.

As seen in FIG. 1, the solenoid 50 is coupled to the end of one leg of the L-shaped choke lever 26 with the linkage rods 42, 46 attached to an end of the other leg with the choke shaft 14B is positioned at the intersection of the two legs. In this manner, as discussed below, the solenoid 50 rotates the choke shaft 14B in the counterclockwise direction to close the choke valve 16 by pulling at the end of the first leg of the choke lever 26. This movement rotates the other leg of the entire choke lever 26 about the axis of the choke shaft 14B which forces the choke linkage 24 downward. The choke linkage 24 in turn rotates the other choke shafts 14 in the same direction (i.e., in the counterclockwise direction in the illustrated embodiment) and to the same degree.

Although not illustrated in FIG. 1, a torsion spring is attached to each choke shaft 14 to bias the corresponding choke valve 16 toward its open position. That is, the springs bias the choke shafts 14 and the choke linkage 24 in a direction opposite that in which the solenoid 50 pulls the shift linkage 24 and rotates the choke shafts 14. In the illustrated embodiment, the springs bias the choke shafts 14 in the clockwise direction.

FIG. 1 also illustrates a choke control mechanism 52 which controls the opening degree of the choke valves 14 at all phases during engine warmup (i.e., during the engine start phase and during the engine warmup phase). The choke control mechanism 52 includes an actuator 54 with an extendable plunger 56. The extent to which the plunger 56 extends from the actuator 54 desirably corresponds to the temperature of the engine, and more preferably corresponds to the temperature of an induction system of the engine, as known in the art.

Figure 2:
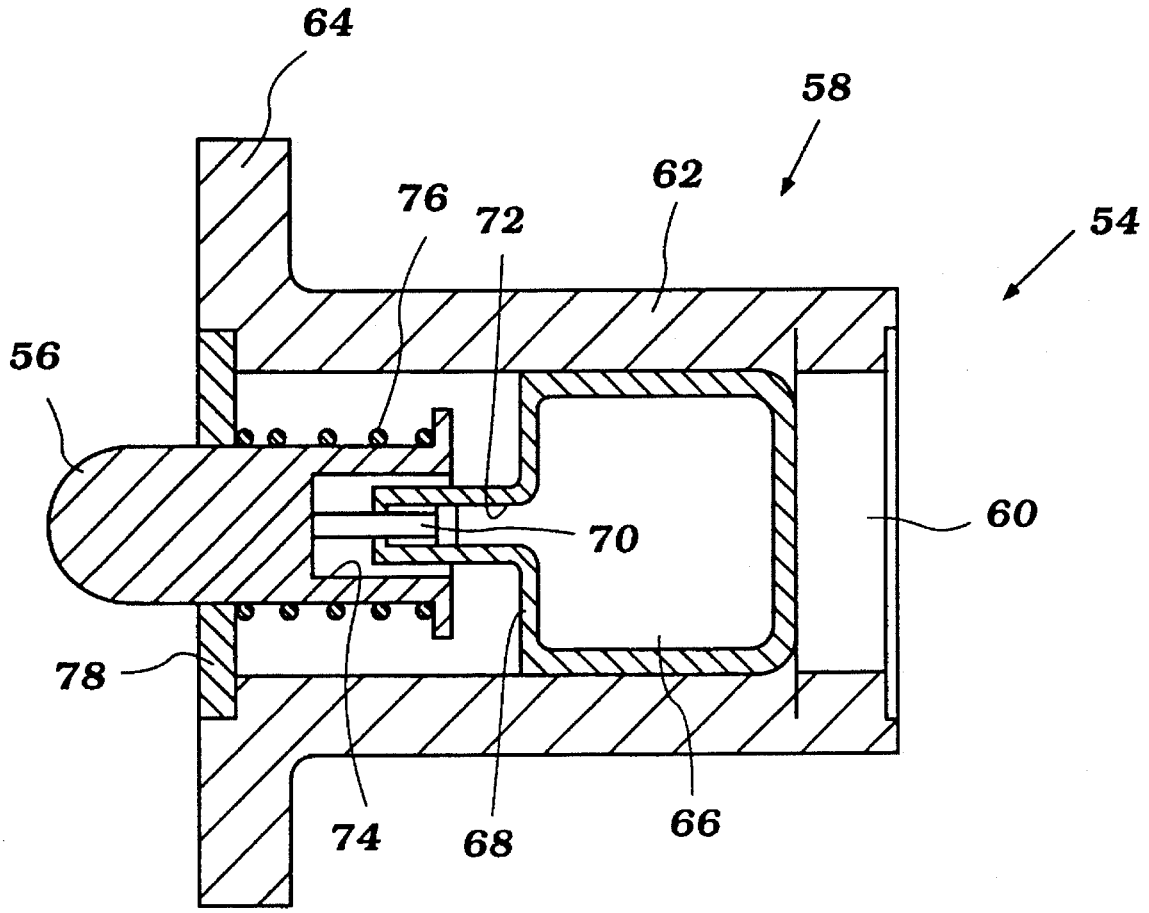
FIG. 2 is a cross-sectional view of an actuator of the choke actuation system of FIG. 1.

A variety of known actuator devices can be used for this purpose. For instance, in the illustrated embodiment, as seen in FIG. 2, the actuator 54 is a conventional wax pellet 58 heated by a positive temperature coefficient (PTC) device 60.

The wax pellet 58 includes a generally tubular body 62 which terminates in an annular flange 64 used for mounting purposes. A reservoir of wax 66, which is housed within a container 68, is positioned within the tubular body 62. The plunger 56 extends from one end of the tubular body 62 at the end circumscribed by the annular flange 64. The plunger 56 includes a piston 70 which rides in a cylinder 72 formed at an end of the wax reservoir container 68. The plunger 56 also includes an inner bore 74 which generally surrounds the cylinder portion 72 of the wax reservoir container 68. An annular flange 76 surrounds an end of the plunger 56 proximate to the inner bore 74. A compression spring 76 is disposed between the annular flange 76 and an end plate 78 which encloses an end of the tubular body 62. The end plate 78 includes an aperture through which the plunger 56 extends.

The PTC device 60 is placed adjacent the wax reservoir 66 at an end of the actuator 54 opposite the plunger 56. The PCT device 60 desirably is tuned such that the rise rate in temperature produced by the PCT device generally matches that of the engine, and more particularly the induction system. As discussed below, the PTC device 60 heats the wax reservoir 66. As the wax expands, the wax forces the piston 70 in a direction out of the container 68. As a result, the plunger 56 compresses the spring 76 and extends from the actuator housing 62. When the wax cools with decreasing temperature, the spring 72 biases the plunger 56 back into the housing 62.

With reference to FIG. 1, the actuator 54 acts upon a moveable cam 80 which rotates about a support shaft 82. For this purpose, the movable cam 80 includes an aperture 81 which receives a support shaft 82. The movable cam 80 also includes a tang 84 which is distanced from the aperture and forms an abutment surface upon which the actuator plunger 56 acts.

Figure 3:
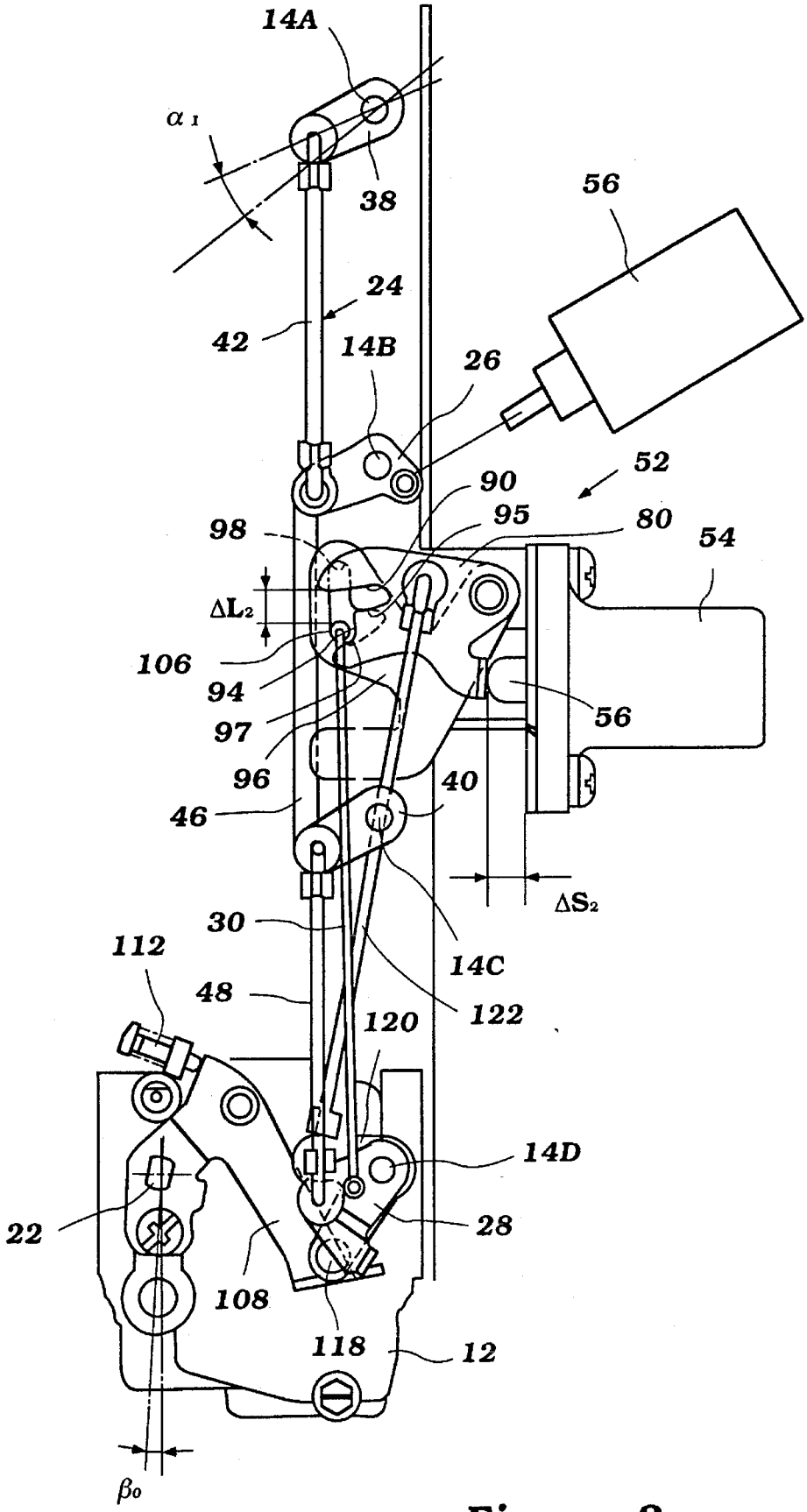
FIG. 3 is a side elevational view of the choke actuation system of FIG. 1 illustrated under cranking conditions at 50° C.

The moveable cam 80 also includes a first finger 86 and a second finger 88 which extend away from the aperture 81. A first cam 90 surface is defined on an inner side of the first finger 86. The first cam surface 90 is generally straight and extends into a U-shaped transitional section 92 which blends into a second cam surface 94 positioned on the inner side of the second finger 88. Proximate to the transitional section 92, the first cam surface 90 and a first section 95 of the second cam surface 94 are generally parallel and slightly spaced apart so as to define a slot. The second cam surface 94 curves away from the first cam surface 90 in a direction extending towards the end of the second finger 88 and transitions into a second section 97 which is generally parallel to the first cam surface 90, so as to form a step in the second cam surface 94, which is best seen in FIG. 3.

The support shaft 82 also supports a fixed member 96 which cooperates with the cam member 80. The fixed member 96 defines a guide slot 98. The guide slot 98 is formed in part by an engagement edge 100 which slopes away from the support shaft 82. The engagement edge 100 blends with a vertically extending edge which defines a portion of a vertical leg 102 of the guide slot 98. An outwardly sloping edge 104 extends between the vertical leg 102 and the engagement edge 100 of the guide slot 98.

As seen in FIG. 1, the moveable cam 80 is positioned above the fixed member 96° Rotation of the cam member 80 about the support shaft 82 varies the overlap pattern between the guide slot 98 of the fixed member 80 and the space defined between the first and second cam surfaces 90, 94 of the moveable cam 80.

The choke control rod 30 extends between the carrier lever 28 and a follower 106 which is captured between the fixed member 96 and the movable cam 80 within a space defined by the overlap between the guide slot 98 and the space defined between the first and second cam surfaces 90, 94. The follower 106 desirably is a roller which rotates over the edges of the first and second cam surfaces 90, 94 and/or over the engagement surface 100 of the fixed member 80. The follower 106 is attached to a transversely bent end of the control rod 30. An opposite end of the control rod 30 is attached to the carrier lever 28 in a known manner, proximate to its second aperture 34.

As seen in FIG. 1, the choke control mechanism 52 also acts upon the throttle shafts 22 of the carburetors 12. For this purpose, a throttle lever 108 is attached to one of the throttle shafts 22. In the illustrated embodiment, the throttle lever 108 is attached to the throttle shaft 22 of the fourth carburetor 12. The throttle lever 108 includes an abutment surface 110 for contact with a throttle adjustment screw 112 that defines the idle position of the throttle valve 18, as known in the art. The throttle lever 108 generally has an L-shape with an aperture receiving the throttle shaft 22 at about the middle of a shorter leg 114 of the throttle lever 108 to fix these two components together. The throttle shaft 22 thus rotates with the throttle lever 108 about an axis of the throttle shaft 22. At the outer end of its longer leg 116, the throttle lever 108 includes a pin 118.

One end of a V-shaped linkage 120 rotatably connects to the pin 118 in a manner permitting the linkage 120 to rotate relative to the throttle lever 108. The linkage 120 also includes an aperture at its apex which receives the fourth choke shaft 14D to rotatable couple the linkage 120 to the choke shaft 14D. The linkage 120 can freely rotate about the choke shaft 14D. The other end of the V-shaped linkage 120 connects to a lower end of a fast idle control rod 122. A conventional clip 44 secures together the lower end of the control rod 122 and the linkage 120.

As seen in FIG. 1, the control rod 122 extends upward to the cam member 80. A conventional clip 44 connects an upper end of the control rod 122 to the cam member 80 at a position proximate to a top end of the cam member 80 and between the transitional section 92 and the support shaft aperture 81. The fixed member, as seen in FIG. 1, includes a relief section 124 to provide clearance for the clip 44 and the end of the control rod 122 as the cam member 80 rotates about the support shaft 82 and over the fixed member 96.

The choke actuation system 10 desirably includes a controller 126 which controls the actuator 54 and the solenoid 50. The controller 126 also communicates with the engine ignition system and/or the engine starter (not shown) to sense cranking of the engine and engine running, as discussed below.

Figure 4:
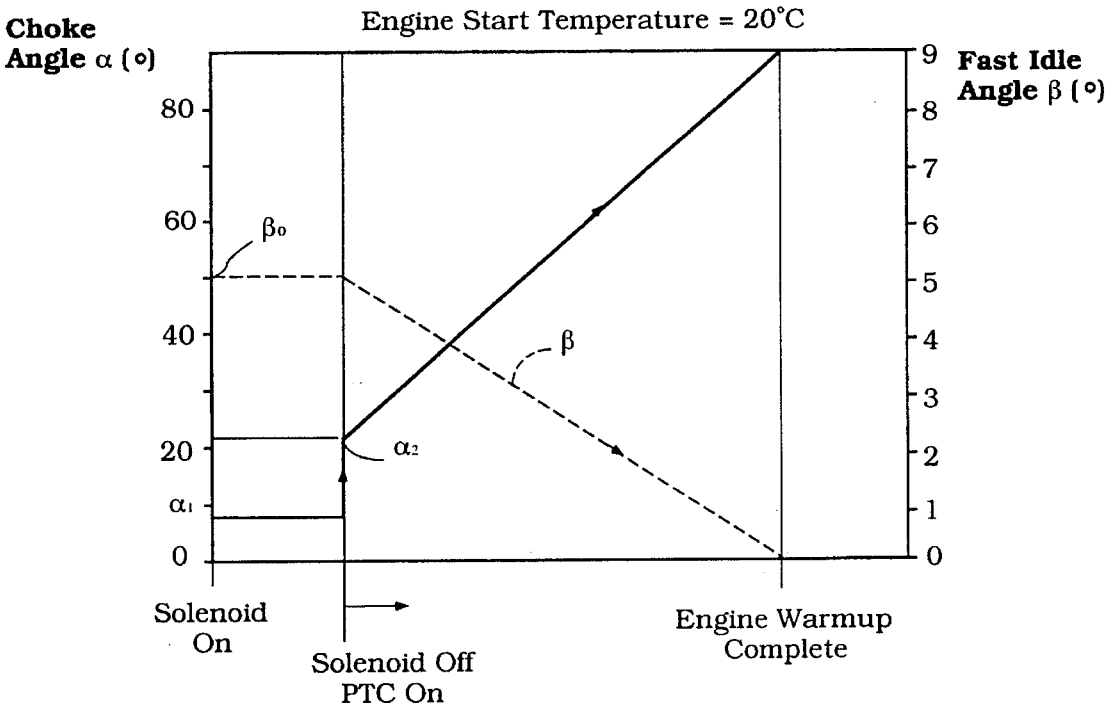
FIG. 4 is a graph illustrating choke angle and fast idle angle during the start and warmup phases of the engine.

The present choke actuation system 10 controls the opening degree of the choke valves 16 and the fast idle angle of the throttle valves 18 when the engine is initially started (i.e., when the engine is cranked) and during engine warmup. The operation of the choke actuation system 10 will now be described primarily with reference to FIGS. 1, 3 and 4. FIG. 4 graphically illustrates the positions of the choke valves and throttle valves during the phases of engine starting and warmup when the engine is started at an initial temperature of 20° C.

Choke Starting Angle

With reference FIG. 1, the controller 126 initially senses activation of the engine starter (not shown) when the engine is cranked. The controller 126 in response energizes the solenoid 50 to close the choke valves 16 of the charge formers 12. The solenoid 50, when energized, pulls on the L-shaped choke lever 26, thereby rotating the choke lever 26 and the corresponding choke shaft 14B. In the illustrated embodiment, the solenoid 50 rotates the choke shaft 14B in the counterclockwise direction. The choke linkage 24 communicates this rotational movement to the other choke shafts 14A, 14C, 14D as the choke lever 26 forces the linkage 24 in the downward direction.

The extent to which the solenoid 50 can rotate the choke shafts 14, however, is limited by the movement of the follower 106 in the guide slot 98 of the fixed member 96. This is because the choke control rod 30 links the choke linkage 24 and choke shafts 14 to the follower 106. The actuator 54 controls the degree to which the follower 106 can move within the guide slot by controlling the position of the cam member's first and second cam surfaces 90, 94 relative to the guide slot 98. Specifically, the second cam surface 94 (i.e., the lower cam surface of the cam member 80) limits the downward movement of the follower 106 within the guide slot 98.

As graphically represented in FIG. 4, when starting the engine at 20° C. the choke control mechanism 52 prevents the solenoid 50 from fully closing the choke valves. By controlling the position of its cam member 80, the choke control mechanism 52 establishes a choke starting angle $\alpha_1$ of about 9°, which is the desired choke starting angle $\alpha_1$ for an engine temperature of 20° C.

The function of the choke control mechanism 52 in setting the choke starting angle $\alpha_1$, is further illustrated by a comparison of the present choke actuation system 10 under starting conditions at −5° C. and 50° C., as illustrated by FIGS. 1 and 3, respectively.

As seen in FIG. 1, at −5° C., the actuator plunger 56 extends from the actuator 54 by only a slight distance $\Delta S_1$. In this position, the cam member 80 is fully rotated in the counterclockwise direction, and the first section 95 of the second cam surface 94 generally lies over the engagement edge 100 of the fixed member 96. The engagement edge 100 and second cam surface 94 together limit the downward movement of the follower 106. This position of the follower 106 desirably corresponds the fully closed position of the choke valve 16 (i.e., choke angle $\alpha$=0°). Therefore, when the engine temperature is −5° C., the solenoid 50 fully closes the choke valves 16 when cranking the engine.

With reference to FIG. 3, at 50° C., the actuator plunger 56 extends from the actuator 54 by a increased amount $\Delta S_2$ ($\Delta S_2 > \Delta S_1$) due to wax expansion in the wax pellet 58 at the increased temperature. The increased extension of the plunger 56 rotates the movable cam 80 in a clockwise direction around the support shaft 82. This movement of the cam member 80 rotates the second cam surface 94 above the guide slot 98. In this position, as seen in FIG. 3, the second cam surface 94 prevents the follower 106 from contacting the engagement edge 100 of the guide slot 98, as it did when operating at a substantially lower temperature (see FIG. 1). The moveable cam 80 thus restricts the downward movement of the control rod 30, and consequently, the degree to which the solenoid 50 can close the choke valves 16 is restricted further. In other words, the opening degree of the choke valves 16 is larger at an elevated temperature than at a lower temperature.

Fast Idle Angle

As noted above, the present choke actuation system 10 also controls the fast idle angle of the throttle valves 18 according to the engine's starting temperature. With reference back to FIG. 1, the fast idle control rod 122 communicates the position of the cam member 80 to the linkage 120. As the cam member 80 rotates in one direction, the linkage 120 rotates about the fourth cam shaft 14D in the same direction. In the illustrated embodiment, counterclockwise rotation of the cam member 80 rotates the linkage 120 in the counterclockwise direction. This rotation of the linkage 120 moves the pin 118 downward which causes the throttle linkage 108, and thus the throttle shaft 22, to rotate clockwise, thereby increasing the opening degree of the throttle valve 18. The increased opening degree over the normal idle angle of the throttle valve 18 is the fast idle angle $\beta$.

The position of the cam member 80 of the choke control mechanism 52 therefore also initially establishes the desired fast idle angle $\beta$ for the throttle valves 18. As illustrated in FIG. 4, at an initial engine temperature of 20° C. the choke control mechanism desirable sets the fast idle angle initially at about 5°.

The function of the choke control mechanism 52 in setting the initial fast idle angle $\beta_0$, again is illustrated further by a comparison of the present choke actuation system 10 under starting conditions at −5° C. and 50° C., as illustrated by FIGS. 1 and 3, respectively.

With reference to FIG. 1, the cam member 80 is fully rotated in the counterclockwise direction with limited protrusion $\Delta S_1$ of the plunger 56 from the actuator body 54. The control rod 122, attached to the cam member 80, pushes down on the linkage 122 which rotates in response about the choke shaft 14D in the counterclockwise direction. This movement causes the throttle lever 108 to rotate in the clockwise direction to open the throttle valves 18 from their normal idle position. In the illustrated embodiment, the maximum fast idle angle $\beta$ desirably is set at about 7.4° when the engine is started at −5° C.

With reference to FIG. 3, the plunger 56 projects from the actuator 54 by an increased amount $\Delta S_2$ and rotates the cam member 80 clockwise at the elevated temperature of 50° C. The control rod 122 translates this position to the linkage 122 which rotates clockwise about the choke shaft 14D in response. Clockwise rotation of the linkage 122 draws the pin 118 upwards, which causes the throttle lever 22 to rotate counterclockwise. As a result, the initial fast idle angle $\beta_0$ decreases until the throttle lever 108 rotates to a position corresponding to the normal idle position of the throttle valve 18 set by the adjustment screw 112.

Choke and Throttle Running Angles

After the engine starts, the controller 126 deenergizes the solenoid 50 and energizes the PCT heater 60 of the choke control mechanism 52. When the controller 126 shuts off the solenoid 50, the choke control mechanism 52 allows the choke valves 16 to open to the desired choke running angle $\alpha_2$, as graphically illustrated in FIG. 4. The choke control mechanism 52 then increases the opening degree of the choke valves 16 at a steady rate (see FIG. 4), as the engine warms. The choke control mechanism 52 also steadily decreases the fast idle angle $\beta$ back to its normal idle angle. As represented in FIG. 4, at the time the engine has warmed to its designed operating temperature, the choke control mechanism has fully opened the choke valves 16 and has decrease the fast idle angle back to its normal idling position.

The present choke actuation system 10 performs the above-described operation during engine warmup as follows. When the controller 126 deenergizes the solenoid 50, the torsion springs (not shown) bias the choke valves 16 open. The degree to which the choke valves 16 can open, however, corresponds to a moveable distance ΔL of the follower 106 within the guide slot 98 of the fixed member 96.

For instance, with reference to FIG. 1, the first cam surface 90 (i.e., the upper cam surface) of the movable cam 80 prevents the follower 106 from moving substantially upward at a start temperature of −5° C. As a result, the choke valves 16 open only slightly after the engine is started.

FIG. 3 illustrates the movable distance ΔL at 50° C. The movable distance ΔL of the follower 106 within the guide slot 98 is now defined by the distance between the first cam surface 90 and the second section 97 of the second cam surface 94. Consequently, the follower 106 can move in the upward direction by a greater distance $\Delta L_2$, thereby allowing the springs to bias the choke valves 16 open by a greater degree after the engine is started and the controller 126 deenergizes the solenoid 50.

At the same time the springs open the choke valves to an initial running choke angle, the controller 126 also energizes the PTC heater 60 of the actuator 54. The PTC heater 60 heats up the wax in the container 66 at a rate substantially equal to the rate at which the engine temperature rises. The wax expands and pushes the plunger 56 outward.

As the projection amount ΔS of the plunger 56 increases, the cam member 80 rotates clockwise about the support shaft 82. The choke control rod 30 transfers this motion to the carrier lever 28. The choke linkage 24 in turn transmits this clockwise rotation of the carrier lever 28 to the other choke levers, which rotate the corresponding choke shafts 14. In this manner, the choke control mechanism 52 increases the choke angle α of each choke valve 16 as the engine warms after starting, as graphically illustrated in FIG. 4.

With reference back to FIG. 1, the clockwise movement of the cam member 80 with the rise in engine temperature, is also transmitted to the linkage 120. The fast idle control rod 122 rotates the linkage 120 clockwise, and pulls the pin 118 upwards. This upward movement of the pin 118 rotates the throttle lever 108 counterclockwise to decrease the fast idle angle β of the throttle valves. The decrease of the fast idle angle β with the increase of engine temperature is graphically represented in FIG. 4.

Figure 5:
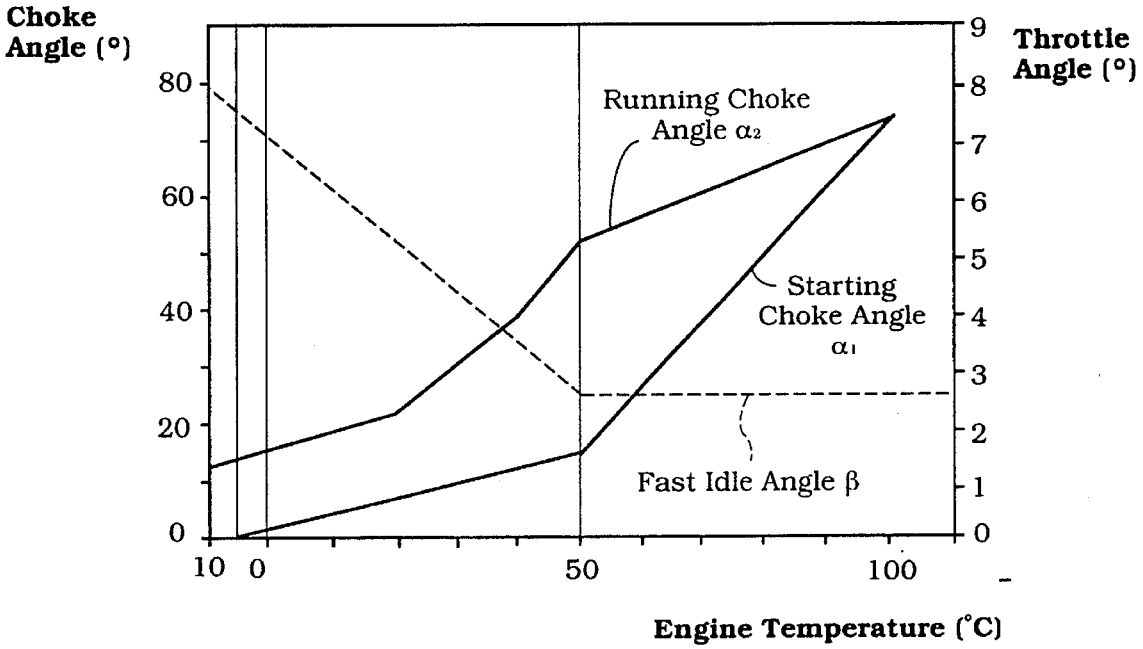
FIG. 5 is a graph illustrating choke starting angle, choke running angle, and fast idle angle verses temperature.

In order to optimize engine performance and efficiency, the present choke actuation system 10 controls the opening degrees of the choke valves 16 and throttle valves 18 according to temperature in a non linear manner. FIG. 5 graphically illustrates this point.

The graph of FIG. 5 illustrates the starting choke angle $\alpha_1$ in relation to engine temperature. As illustrated by the graph, the opening degree of the choke valve at engine starting increases as the starting temperature increases from −5° C. to 50° C. The initial opening degree (i.e., starting choke angle $\alpha_1$) increases generally linearly with increased temperature.

With reference to FIG. 1, it should be noted that during this temperature range, the first section 95 of the second cam surface 94 limits downward motion of the followers 106 because the follower 106 is captured within the slot defined by the first and second cam surfaces 90, 94, proximate to the transition section 92.

With reference back to FIG. 5, at temperatures above 50° C. the opening degree of the choke valves 16 also increases in a linear manner, but at a greater differential between starting temperatures. The change in differential at about 50° C. is due to the step in the second cam member 94 (best seen in FIG. 3).

With reference to FIG. 3, the interaction between the upper edge 104 of the guide slot 96 and the second cam surface 94 forces the follower 106 out of the slot formed between the first and second cam surfaces 90, 94 of the cam member 80 at a starting temperature of about 50° C. The follower 106 consequently contacts the second section 97 of the second cam surface 94. In this position, the follower 106 is distanced further from the axis of rotation of the cam member 80, and the same change in plunger extension produces a greater change in the opening degree of the choke valves 16. That is, for the same change in plunger extension, the plunger 56 moves the follower 106 upward by a greater amount than it does when the follower 106 contacts the first section 95 of the second cam surface 94 (as seen in FIG. 1). In this manner, the present choke actuation system 10 adjusts the start choke angle $\alpha_1$ non-linearly in accordance with engine temperature.

The graph of FIG. 5 also illustrates the choke running angle $\alpha_2$ established by the present choke actuation system 10. As seen in FIG. 5, the running choke angle also increases non-linearly as the engine warms.

The graph of FIG. 5 further depicts the decrease in the fast idle angle β according to engine temperature. At low temperatures (e.g. 5° C.), the fast idle angle β is greater than at higher temperatures (e.g. 50°). Specifically, the fast idle angle β desirably is set about 8° for temperatures below freezing and decreases linearly to about 3° when the engine temperature is 50° C. or higher. That is, as the engine temperature rises, the present choke actuation system 10 reduces the fast idle angle β. When engine temperature is more than 50° C., the present choke actuation system 10 fixes the fast idle angle β at about 3°, which is generally equal to the normal idle angle of the throttle valve 18.

Although this invention has been described in terms of a certain preferred embodiment, other embodiments apparent to those of ordinary skill in the art are also within the scope of this invention. Accordingly, the scope of the invention is intended to be defined only by the claims which follow.

What is claimed is:

1. An engine choke actuation system for use with at least two charge formers, each charger former having a choke valve operated by a choke shaft, said choke shaft moving said choke valve through a range of opening degrees between a closed position and a full open position, said engine choke actuation system comprising a first device acting to close said choke valves at the time of engine starting, and a second device which restricts the degree of closure of the choke valves by the first device depending upon the temperature at the time of engine starting, and which controls the opening degree of choke valves after engine starting, said second device comprising an actuator including a linear plunger which extends from a body of said actuator and moves relative to said body depending upon the temperature of said actuator, and a positive temperature coefficient device which heats said actuator body.

2. The choke actuation system of claim 1, wherein said second device controls the opening degree of the choke valve after engine starting such that the opening degree of said choke valve increases as the temperature increases.

3. The choke actuation system of claim 1, wherein said second device comprises a cam mechanism which includes a movable cam upon which said actuator acts.

4. The choke actuation system of claim 3, wherein said movable cam includes at least two cam surfaces.

5. The choke actuation system of claim 1, wherein each charge former includes a throttle valve operated by a throttle shaft, said throttle shaft moving said throttle valve through a range of opening degrees, and said second device of said choke actuation system being coupled to said throttle shafts so as to control the opening degree of said throttle valves during engine warmup.

6. An engine choke actuation system for use with at least one charge former having a choke valve operated by a choke shaft, said choke shaft moving said choke valve through a range of opening degrees between a closed position and a full open position, said engine choke actuation system comprising a first device acting to close said choke valve at the time of engine starting, and a second device which restricts the degree of closure of the choke valve by the first device depending upon the temperature at the time of engine starting, and which controls the opening degree of the choke valve after engine starting such that the opening degree of said choke valve increases as the temperature increases said second device comprises an actuator operating a movable cam member which rotates relative to a fixed member of said second device, said cam member having a first cam surface and a second cam surface and said fixed member having a guide slot formed in part by an engagement edge.

7. The choke actuation system of claim 6, wherein said first cam surface limits the degree to which said first device can close said choke valve when starting the engine at a temperature within a first temperature range, and said engagement edge of said fixed member limiting the degree to which said first device can close said choke valve when starting said engine at a temperature within a second temperature range.

8. The choke actuation system of claim 7, wherein said first temperature range is above said second temperature range.

9. The choke actuation system of claim 6, wherein said second cam surface of said cam member limits the opening degree of said choke valve after engine starting.

10. The choke actuation system of claim 6 additionally comprising a rod which couples said first device to said second device, and a follower attached to an end of said rod and captured within said guide slot of said fixed member between said first and second cam surfaces of said cam member.

11. The choke actuation system of claim 10, wherein said rod is movable from a first position corresponding to the closed position of said choke valve to a second position corresponding to an open position of said choke valve, and said second cam surface of said cam member limits the extent of movement of said rod in a direction towards said second position.

12. The choke actuation system of claim 10, wherein said second cam surface of said cam member limits the extent of movement of said rod in a direction towards said first position when starting the engine at a temperature within a first temperature range, and said engagement edge of said fixed member limiting the extent of movement of said rod in the direction towards said first position when starting the engine at a temperature within a second temperature range, said first temperature range being above said second temperature range.

13. The choke actuation system of claim 6, wherein said actuator includes a plunger which extends from a body of said actuator, the extent of actuation of said plunger depending upon the temperature of said actuator.

14. The choke actuation system of claim 13, wherein said actuator additionally includes a reservoir of wax which expands when heated, said plunger coupled to said reservoir such that expansion of said wax within said reservoir actuates said plunger.

15. The choke actuation system of claim 14, wherein said actuator additionally includes a positive temperature coefficient device which is positioned adjacent to said reservoir of wax so as to heat the wax when energized.

16. The choke actuation system of claim 6 additionally comprising a controller coupled to said first and second devices, and wherein said actuator includes a positive temperature coefficient device and said first device comprises a solenoid which is coupled to said choke shaft to generally close said choke valve when energized, said controller energizing said solenoid at the time of engine starting to generally close the choke valve, and after engine starting, said controller de-energizing said solenoid to open the choke valve, and energizing said positive temperature coefficient device of said actuator to control the opening degree.

17. The choke actuation system of claim 6, wherein said first device comprises a solenoid which is coupled to said choke shaft to generally close the choke valve when said solenoid is energized.

18. The choke actuation system of claim 17, wherein said choke actuation system is used with a plurality of charger formers arranged so that the choke shafts of the charge formers are spaced apart from one another, and said first device comprises a linkage system coupled to said solenoid of said first device, said linkages system interconnecting said choke shafts such that said solenoid moves said choke shafts together generally in the same direction and generally to the same extent.

19. The choke actuation system of claim 18, wherein said linkage system comprises a plurality of choke levers, each choke lever being attached to one of said choke shafts, and a plurality of linkage rods each of which interconnects a pair of adjacent choke levers of said plurality of choke levers.

20. The choke actuation system of claim 6, wherein the charge former includes a throttle valve operated by a throttle shaft, said throttle shaft moving said throttle valve through a range of opening degrees, and said second device of said choke actuation system coupled to said throttle shaft so as to control the opening degree of said throttle valve during engine warmup.

21. The choke actuation system of claim 20 additionally comprising a throttle control linkage which couples an actuator of said second device to said throttle shaft such that actuation of said actuator acts on the throttle shaft.

22. The choke actuation system of claim 21, wherein said actuator operates said throttle shaft so as to decrease the opening degree of the throttle valve as temperature increases.

23. The choke actuation system of claim 21, wherein said throttle control linkage comprises a linkage rod which interconnects a cam member of said second device, which is operated by said actuator, to a rotatable linkage member of said throttle control linkage, said rotatable linkage member being connected to a throttle lever which is coupled to the throttle shaft.

24. An engine choke actuation system for use with at least two charge formers, each charge former having a choke valve operated by a choke shaft, said choke shaft moving said choke valve through a range of opening degrees between a closed position and a full open position, each charge former also including a throttle valve operated by a throttle shaft, said throttle shaft moving said throttle valve through a range of opening degrees, said engine choke actuation system comprising a first device acting to close said choke valves at the time of engine starting, a second device which restricts the degree of closure of the choke valves by the first device depending upon the temperature at the time of engine starting, and which controls the opening degree of choke valves after engine starting, said second device comprising an actuator including a positive temperature coefficient device, said second device of said choke actuation system being coupled to said throttle shafts so as to control the opening degree of said throttle valves during engine warmup, and a throttle control linkage which couples said actuator of said second device to said throttle shaft such that said actuator operates said throttle shaft so as to decrease the opening degree of the throttle valve as temperature increases, said throttle control linkage comprising a linkage rod which interconnects a cam member of said second device, which is operated by said actuator, to a rotatable linkage member of said throttle control linkage, said rotatable linkage member being connected to a throttle lever which is coupled to the throttle shaft.

25. An engine choke actuation system for use with at least one charge former having a choke valve operated by a choke shaft, said choke shaft moving said choke valve through a range of opening degrees between a closed position and a full open position, said engine choke actuation system comprising a choke lever attached to said choke valve shaft, a first device coupled to said choke lever so as to close said choke valve at the time of engine starting, and a second device coupled to said choke lever separately from said first device so as to restrict the degree of closure of the choke valve by the first device depending upon the temperature at the time of engine starting, and said second device also acting upon said choke lever to open the choke valve after starting the engine.

26. The choke actuation system of claim 25, wherein said second device includes a cam mechanism connected to said choke lever and an actuator acting on said cam mechanism.

27. The choke actuation system of claim 26, wherein said actuator includes a positive temperature coefficient device.

28. The choke actuation system of claim 26, wherein said cam mechanism includes a movable cam upon which said actuator acts.

29. The choke actuation system of claim 28, wherein said second device includes a control rod which connects said movable cam to said choke lever.

30. The choke actuation system of claim 29, wherein an end of said control rod includes a follower which contacts at least one cam surface of said movable cam.

31. The choke actuation system of claim 30, wherein said movable cam rotates over a fixed plate, said fixed plate including an aperture which receives a portion of said follower at the end of said control rod.

32. The choke actuation system of claim 31, wherein said aperture of said fixed plate cooperates with the cam surfaces of said movable cam to establish a first choke valve position with said first device actuated to close said choke valve and a second choke valve position with said first device unactuated.

33. The choke actuation system of claim 32, wherein said actuator moves said cam surfaces of said movable cam relative to said aperture of said fixed plate with a change of temperature.

34. The choke actuation system of claim 28 additionally comprising a second control rod connected throttle control mechanism such that said throttle control mechanism follows the movement of said movable cam.

* * * * *